US010345063B1

(12) United States Patent
Taylor

(10) Patent No.: US 10,345,063 B1
(45) Date of Patent: Jul. 9, 2019

(54) MULTI-FUNCTION FIREARM MAGAZINE FLOORPLATE WITH CONTOURED BASE AND COUPLING STRUCTURE

(71) Applicant: Robin Taylor, Bellingham, WA (US)

(72) Inventor: Robin Taylor, Bellingham, WA (US)

( * ) Notice: Subject to any disclaimer, the term of this patent is extended or adjusted under 35 U.S.C. 154(b) by 0 days.

(21) Appl. No.: 16/350,006

(22) Filed: Sep. 10, 2018

(51) Int. Cl.
*F41A 9/61* (2006.01)
*F41A 9/65* (2006.01)

(52) U.S. Cl.
CPC ..... *F41A 9/65* (2013.01)

(58) Field of Classification Search
CPC ..... F41A 9/65; F41A 9/68; F41C 27/00
See application file for complete search history.

(56) References Cited

U.S. PATENT DOCUMENTS 3,191,332 A * 6/1965 Ardolino ..... F41A 9/63 42/50
4,685,238 A * 8/1987 Schoepflin ..... F16B 5/0004 42/90
5,438,783 A * 8/1995 Sniezak ..... F41A 9/65 42/50
6,581,136 B1 * 6/2003 Tuccio ..... G06F 3/061 370/360
6,668,479 B1 * 12/2003 Obong ..... F41A 9/63 206/3
8,739,451 B2 * 6/2014 Nelson ..... F41A 9/65 220/23.4
10,094,630 B1 * 10/2018 Loveday, IV ..... F41A 9/65
2005/0011097 A1 * 1/2005 Freed ..... F41A 9/65 42/49.02
2011/0107645 A1 * 5/2011 Faifer ..... F41A 9/63 42/90
2014/0352189 A1 * 12/2014 Fitzpatrick ..... F41A 9/69 42/50
2015/0121736 A1 * 5/2015 Faifer ..... F41A 9/65 42/49.01
2016/0003567 A1 * 1/2016 Purkiss ..... F41A 9/68 42/49.01
2016/0033220 A1 * 2/2016 Grandy ..... F41A 9/63 42/49.01
2017/0160038 A1 * 6/2017 Keng ..... F41A 23/04

FOREIGN PATENT DOCUMENTS

CA 2945224 A1 * 4/2018 ..... F41A 9/63

* cited by examiner

*Primary Examiner* — Gabriel J. Klein
(74) *Attorney, Agent, or Firm* — Todd N. Hathaway and Associates; Harold H. Bennett, II

(57) ABSTRACT

A firearm magazine floorplate is provided, configured to be attached to a magazine housing. The floorplate includes an arcuate back face configured to provide a stable resting platform during operation. The floorplate further includes a feature configured to mate with a corresponding feature on one end of a magazine coupler. The magazine couple is easily engaged or disengaged between a pair of magazine assemblies that each include a floorplate to form or disassemble a tandem magazine assembly.

13 Claims, 5 Drawing Sheets

MULTI-FUNCTION FIREARM MAGAZINE FLOORPLATE WITH CONTOURED BASE AND COUPLING STRUCTURE

CROSS-REFERENCE TO RELATED APPLICATION

This application claims the benefit under 35 U.S.C. § 119(e) of U.S. Provisional Patent Application No. 62/554,455, filed 8 Sep. 2017, which provisional application is incorporated herein by reference in its entirety.

BACKGROUND

Technical Field

The present invention relates generally to the field of firearm accessories, and more particularly, to magazine floorplates, extensions, and couplers.

Description of the Related Art

Shooting sports are extremely popular in many countries around the world, including the United States, and include a number of different types of shooting competitions. Different categories include tests of accuracy at specific prescribed distances, proficiency with different types of firearms, rapid fire competitions, practical shooting competitions, etc. In some competitions, a competitor is limited to specific magazine loads—e.g., five, ten, or twenty cartridges per load, etc., while in others, the competitor selects the most practical load quantities, considering the number of targets, the size and weight of the loaded magazines, the time required to replace an empty magazine, etc. Some competitions are for individual shooters, while others are team-based. Competitions may also be classified by age and/or gender of the competitors.

Because of the degree of interest in the sport, a number of after-market accessories have been developed that cater to the competition shooting market, such as, for example, various types of gunsights, scopes, firearm carrying rigs, cartridge magazines of various types and capacities, and apparel adapted for use in different types of competitions.

BRIEF SUMMARY

Brief Description of the Drawings

FIGS. 5A and 5B are side elevational views of a firearm magazine assembly that includes a floorplate similar to that of FIGS. 2-4 in use with a magazine housing like the housing of the magazine of FIG. 1, according to an embodiment, in which FIG. 5A shows the assembly with the floorplate positioned to be coupled to the magazine housing, while FIG. 5B shows the floorplate fully coupled to the magazine housing.

DETAILED DESCRIPTION

Figure 1:
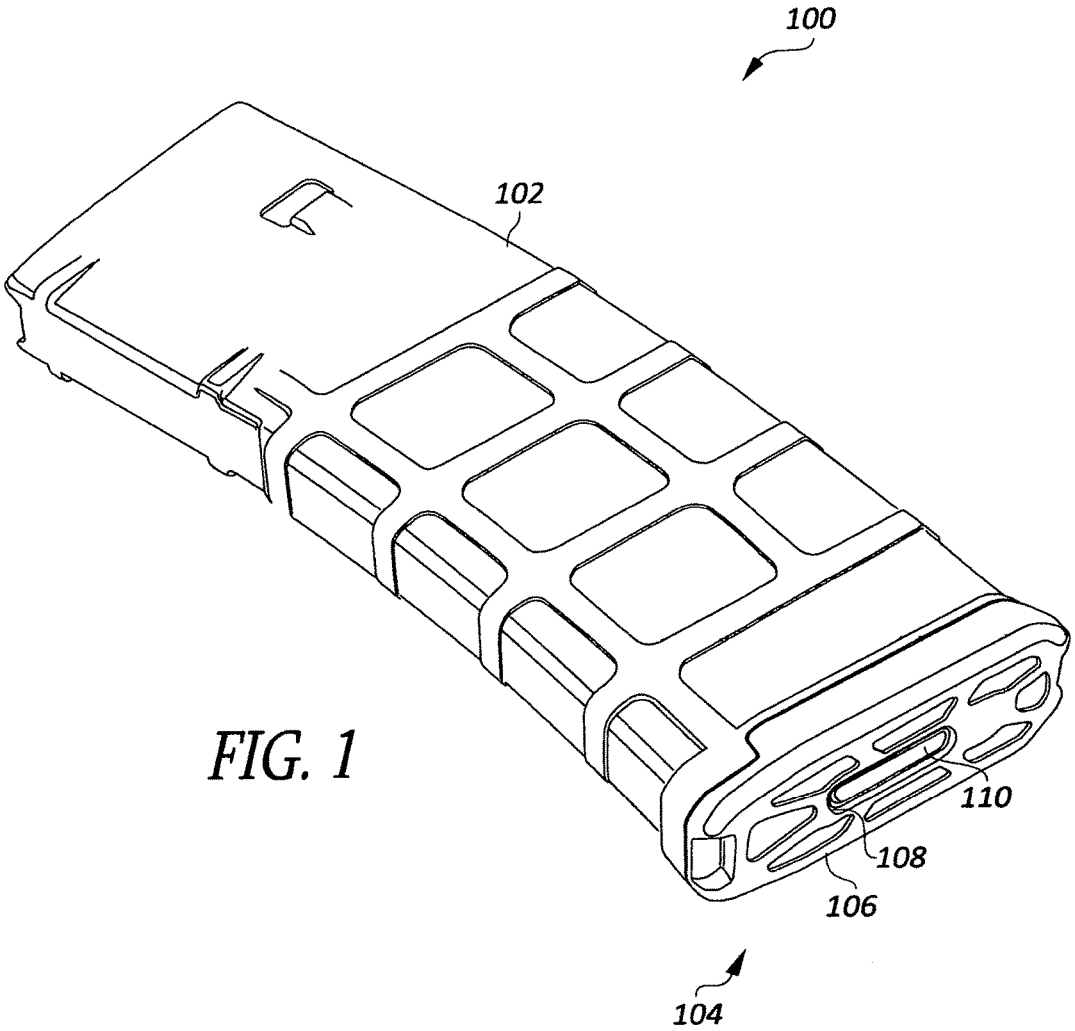
FIG. 1 is a perspective view of a magazine for use in a firearm.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

A number of specialty manufacturers offer accessories for competition shooters, including magazines configured to fit the more popular types and calibers of firearms. In some cases, the magazines are designed for general use, or to be adaptable for use under a wide range of conditions. In other cases, the magazines are optimized for use in specific types of competition, or for use by military or police personnel. Additionally, some manufacturers offer products for after-market modifications of magazines, to provide some preferred upgrade, to meet a specific competition rule, etc.

FIG. 1 is a perspective view of a magazine 100 for use in a firearm. The example shown is a Pmag® 30 Gen 3™ magazine sold by Magpul Industries, Corp., which has a capacity of 30 5.56×45 mm cartridges. This manufacturer also makes and sells magazines of this type with various other capacities including 10, 20, and 40 cartridge sizes. This magazine can be used with AR 15 rifles, as well as M-16 rifles and M4 carbines, both of which are in extensive use by the U.S. military. Principles of the invention will be described hereafter with reference to this type of magazine, but can be applied to magazines made by many different manufacturers for different types of firearms, and for various caliber sizes and cartridge capacities. Accordingly, the claims are not limited by or to the disclosed embodiments, but only by the explicit limitations recited therein.

The magazine 100 of FIG. 1 includes a housing 102 and a floor plate assembly 104. The floor plate assembly 104 comprises a floor plate 106 and a spring plate that is internal to the housing. The floor plate 106 has an oblong aperture 108 through which a tab 110 of the spring plate extends, from the inside of the housing. The spring plate (inside the housing) is coupled to one end of a magazine spring that is configured to bias cartridges in the magazine 100 toward the end of the housing 102 opposite the floor plate 106, consequently biasing the spring plate against the back side of the floor plate 106. A user can remove the floorplate 106 from the housing 102 by pressing the tab 110 of the spring plate inward against the bias of the magazine spring until the tab clears a base surface on the inside of the floor plate 106. This releases the floor plate 106 to slide laterally, until it is disengaged from the housing 102. The open end of the magazine housing 102 slides along the base surfaced as the floor plate 106 is installed or removed.

Figure 2:
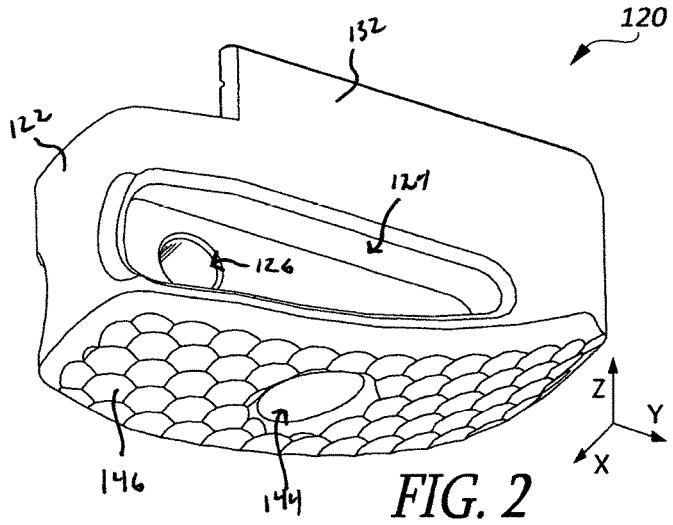
FIG. 2 is a perspective view of a multi-use magazine floorplate, according to an embodiment, that is configured to replace the floorplate of the magazine of FIG. 1.
Figure 3:
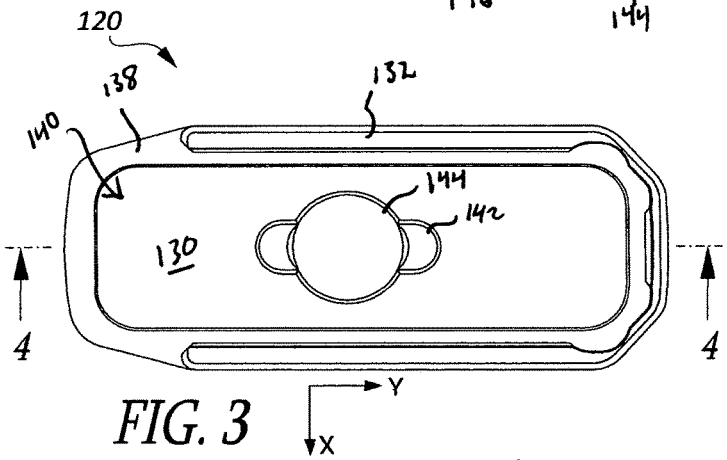
FIG. 3 is a top plan view of the magazine floorplate of FIG. 2.

FIG. 2 is a perspective view of a multi-use magazine floorplate 120, according to an embodiment, that is configured to replace the floorplate 106 of the magazine 100 of FIG. 1. FIG. 3 is a top plan view of the magazine floorplate 120 of FIG. 2, and FIG. 4 is a cross-sectional view of the magazine floorplate in a plane taken along lines 4-4 of FIG. 3.

According to an embodiment, the sides of the floorplate 120 that lie approximately normal to the X axis mirror each other. Thus, the structures of both sides of the floorplate 120, and their functions, can in general be described by reference to a single side.

Figure 4:
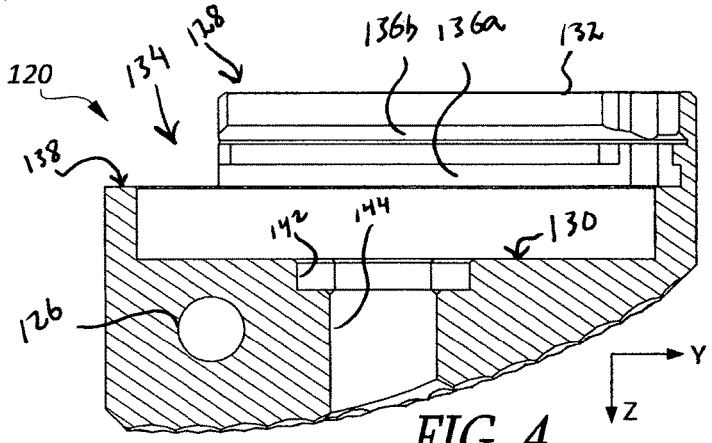
FIG. 4 is a cross-sectional view of the magazine floorplate of FIGS. 2 and 3 in a plane taken along lines 4-4 of FIG. 3.

Referring to FIGS. 2-4, the floorplate 120 includes a body 122 in which a coupler engagement socket 124 is formed in the body 122 on each side of the floorplate 120, and a through-aperture 126 extends between the coupler engagement sockets on opposite sides of the floorplate. The function of the coupler engagement sockets 124 and through aperture 126 will be described later with reference to FIGS. 6 and 7.

Continuing with FIGS. 2-4, the floorplate 120 includes a magazine receiving structure 128 configured to engage a corresponding structure on the magazine housing 102, and to position the floorplate, relative to the housing, such that a floorplate face 130 of the floorplate receives the spring plate of the magazine 100. In the embodiment shown, the magazine receiving structure 128 includes sidewalls 132 extending around three sides of the floorplate face 130 with a notch portion 134 on one end to permit engagement of the floorplate with the magazine housing 102. The sidewalls 132 include grooves 136 configured to engage the features of the magazine housing 102. The cutout portion 134 is defined in the X-Y plane by a base surface 138. In the embodiment shown, an extension cavity 140, which is in part defined by the floorplate face 130, extends into the body 122 of the floorplate 120 so that the floorplate face 130 is separated from the base surface 138 by a selected distance. The extension cavity 140 effectively increases the length of a magazine assembly that includes the floorplate 120, and thus its capacity. According to an embodiment, the extension cavity 140 has a depth of about 0.31 inches, and increases the magazine capacity by two cartridges. Embodiments are envisioned that modify the capacity of a magazine by varius other amounts.

In another embodiment, the extension cavity 140 is omitted, so that the floorplate face 130 and the base surface 138 are substantially coplanar, and the magazine capacity is not changed.

An oblong springplate tab aperture 142 extends into the body 122 from the floorplate face 130, and is positioned such that when the floorplate 120 is coupled to the magazine housing 102, the tab 110 of the springplate engages the springplate tab aperture. A springplate release aperture 144 extends through the body 122 of the floorplate 120 between the floorplate face 130 and a back side 146 of the body, opposite the floorplate face 130, providing access to the tab 110 from the back of the floorplate. The release aperture 144 is sized to comfortably receive a spent shell casing, as a tool for depressing the tab 110. In one embodiment, the release aperture 144 has a diameter of about 0.5 inches, which is adequate to receive the shell casing of a 5.56 mm cartridge, but according to other embodiments, the diameter is selected to accommodate a shell casing of the caliber carried by the magazine for which the respective embodiment is intended.

The springplate release aperture 144 is of particular benefit in embodiments that also include an extension cavity 140. As described with reference to the magazine 100 of FIG. 1, the springplate tab 110 must be depressed a distance sufficient for the tab to clear the base surface 138. This is not difficult with the original floorplate 106. However, referring in particular to FIG. 4, it can be seen that the tab 110 will need to be depressed more than the depth of the extension cavity 140, which would be much more difficult, with an opening the size of the springplate tab aperture 142. The task is made very simple by provision of the springplate release aperture 144, which permits a user to insert a cartridge or shell casing and easily move the springplate tab 110 as far as necessary.

According to an embodiment, finger grips 148 are provided, which enhance a user's comfort and security while handling firearm magazines, particularly under circumstances in which time is critical, such as in many shooting competitions.

The back side 146 of the body 122 has a contour that is arcuate, as viewed in a Y-Z plane, and includes a pebbled or scalloped texture 149, to provide a secure support surface when the magazine assembly is used as a monopod to support a firearm during use.

The floorplate 120 can be made from any appropriate material, including various polymers and metal alloys. According to an embodiment, the floorplate 120 is made of aluminum, such as by machining or casting. According to other embodiments, the floorplate 120 is cast from polymers, such as glass-reinforced nylon, ABS, etc.

The material used and method of manufacturer are design choices that may include consideration of factors such as cost of materials and labor, durability, weight, reliability, service life, etc.

Figure 5A:
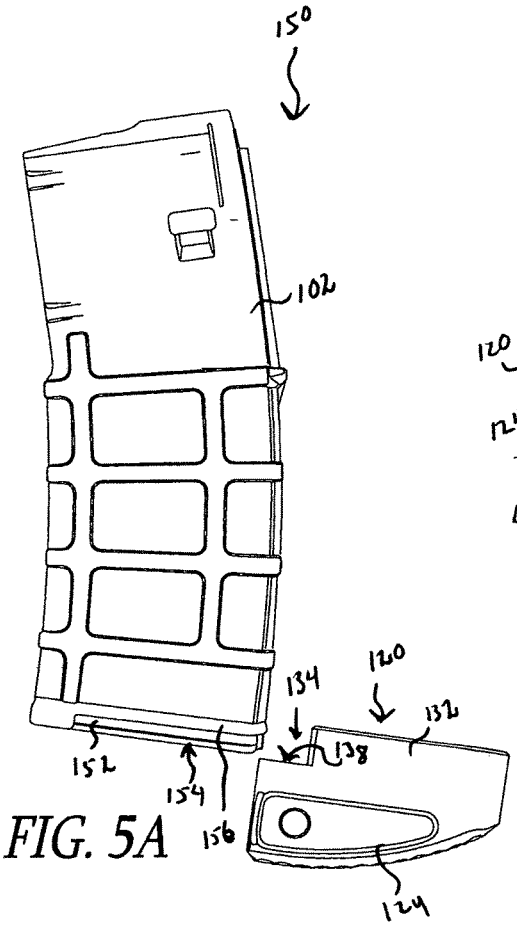
Figure 5B:
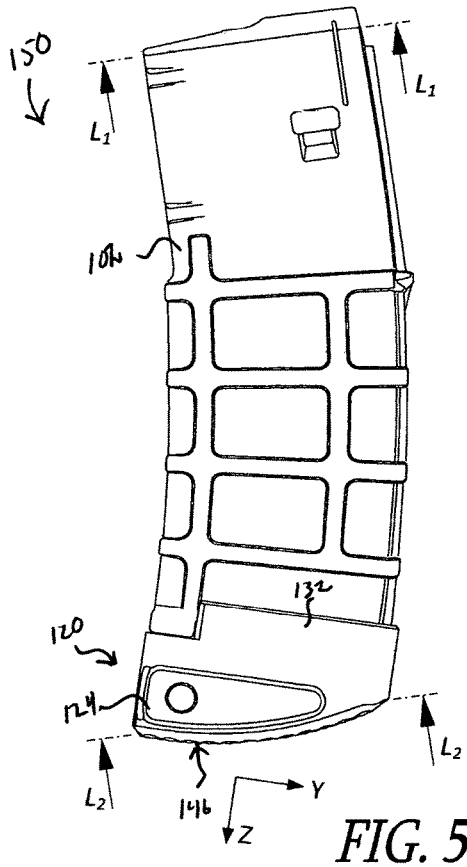

FIGS. 5A and 5B are side elevational views of a firearm magazine assembly 150 that includes a floorplate 120 in use with a magazine housing 102, according to an embodiment. FIG. 5A shows the assembly 150 with the floorplate 120 positioned to be coupled to the magazine housing 102, while FIG. 5B shows the floorplate 120 fully coupled to the magazine housing 102. As noted above, the floorplate 120 includes a a magazine receiving structure 128 configured to cooperate with a corresponding structure of the magazine housing 102 to couple the elements together. The magazine housing 102 includes a slide track 152 on each side, configured to engage a groove on the original floorplate 106. Accordingly, in the present embodiment, corresponding grooves 136 of the magazine receiving structure 128 are provided to interact with the slide tracks 152 of the magazine housing 102. Other embodiments are envisioned that include magazine receiving structures configured to cooperate with the engagement structures of other types of firearm magazines, including those of different types and calibers of firearms, as well as firearm magazines sold by different manufacturers.

To couple the floorplate 120 to the magazine housing 102, a user first presses the springplate into the open end of the magazine housing until it is completely inside the housing, beyond an end face 154 of the magazine housing. While holding the springplate in place, the leading edge of the end face 154 is positioned in contact with the base surface 138 that is exposed within the notch 134 of the floorplate 120. The user then slides the end face 154 of the magazine housing 102 along the base surface 138, the grooves 136 of the floorplate 120 engaging the slide track 152 of the housing 102, until the tab 110 of the springplate is at least partially over the leading edge of the base surface, at which point the user can release the spring plate, while continuing to slide the elements together. As the magazine housing 102 and the floor plate 120 approach full engagement, the springplate is driven by the magazine spring into the extension cavity 140 until the tab 110 is received in the tab aperture 142, locking the floorplate in position.

In use, the coupling elements of the springplate 120 and the magazine 100 may be subjected to more stress than was anticipated in the original design of the magazine 100. For example, in the original design, as shown in FIG. 1, the floor plate 106 offers relatively little area for a user to grip the magazine, while in contrast, the extended depth of the floorplate 120, the coupler engagement sockets 124, and the finger grips 148 provide significantly improved handling characteristics, which permit a user to more quickly and surely remove spent magazines from the magazine well of a firearm, extract fresh magazines from storage pockets or cases, and move them into position to be inserted into the magazine well, all of which can provide a competitive advantage to the user during a timed shooting exercise, for example. The assembly may be subjected to further stresses when the floorplate 120 is used with a coupler, as will be described later. Furthermore, magazines of the type described with reference to FIG. 1 are typically made of a polymer, while the inventor currently manufactures floorplates using aluminum, which is more durable and reliable, but can further stress the polymer material of the magazine housing. Stresses like those described above can increase the likelihood of a failure in which the floor plate 120 separates from the magazine housing 102.

To reduce the likelihood of failure of the coupling connection of the floorplate 120 with the magazine housing 102, according to an embodiment, the sidewalls 132 of the floorplate 120 extend further up the sides of the magazine housing 102 than in the original design—compare, for example, the position of the sidewalls 132 on the magazine housing 102, as shown in FIG. 5B, with the position of the corresponding features of the original floorplate 106 shown in FIG. 1. The sidewalls 132 are provided with two grooves 136*a*, 136*b* on each side of the floorplate 120 (best shown in FIG. 4), configured to engage respective elements of the magazine housing 102. The first grooves 136*a* engage the same slide track 150 of the magazine 102 that is engaged by grooves of the original floorplate 106. The second grooves 136*b* engage a raised flare feature 154 that extends around the magazine housing 102 and that is designed to meet the upper edge of the floorplate 106 and blend the contours of the magazine housing and floorplate—as shown in FIG. 1. According to an embodiment, the first groove 136*a* has a substantially square profile that engages the corresponding square profile shape of the slide track 152 of the magazine housing, while the second groove 136*b* has a profile with an angled face that provides broad contact with the shape of the flare feature 154, providing increased security and durability of the assembly.

In the orientation shown in FIG. 5B, the magazine assembly 150 is configured to feed cartridges into a rifle whose barrel extends to the right. When engaged in the magazine well of the rifle, the barrel lies substantially parallel to a line $L_1$. Thus, when a user is holding the rifle with the barrel approximately level, the line $L_1$ will also be level, with the magazine assembly 150 curving forward. Because of the shape of the magazine housing 102, which is curved to accommodate a cumulative difference in height of ends of a stack of slightly tapered cartridges, the bottom of the magazine housing 102 does not lie parallel with the barrel. Referring to the original design shown in FIG. 1, if the user rests the bottom of the magazine 100 on a surface to support the rifle, with the barrel level, the back edge of the floor plate 106 will make contact, and the contact surface will vary according to the angle of the barrel. This adds complexity to the task of aiming the rifle, and can adversely affect accuracy.

Returning to FIG. 5B, line $L_2$ is a secant that defines the ends of the arcuate shape of the back side 146 of the floorplate 120. The line $L_2$ lies substantially parallel with the line $L_1$, meaning that if the user rests the magazine assembly 150 on a horizontal surface with the barrel of the firearm level, the arcuate back side 146 will make contact at the center of the arc. While adjusting the aim up or down, the back side 146 rocks in an even motion across the arc, providing a stable, predictable movement that can improve control and accuracy. The textured surface 149 reduces the likelihood of slipping on uneven or rough surfaces.

Figure 6:
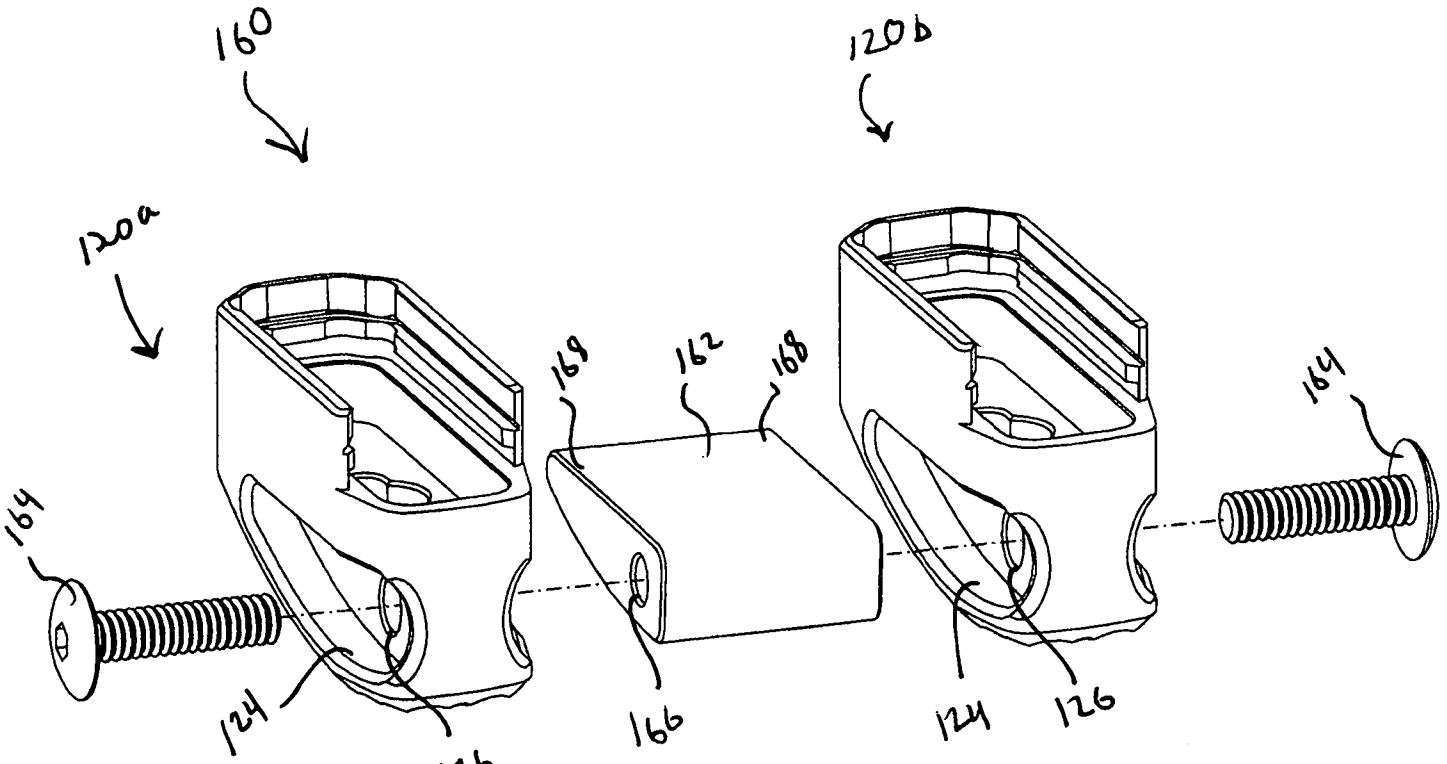
FIG. 6 is an exploded perspective view of a magazine coupler assembly, according to an embodiment.
Figure 7:
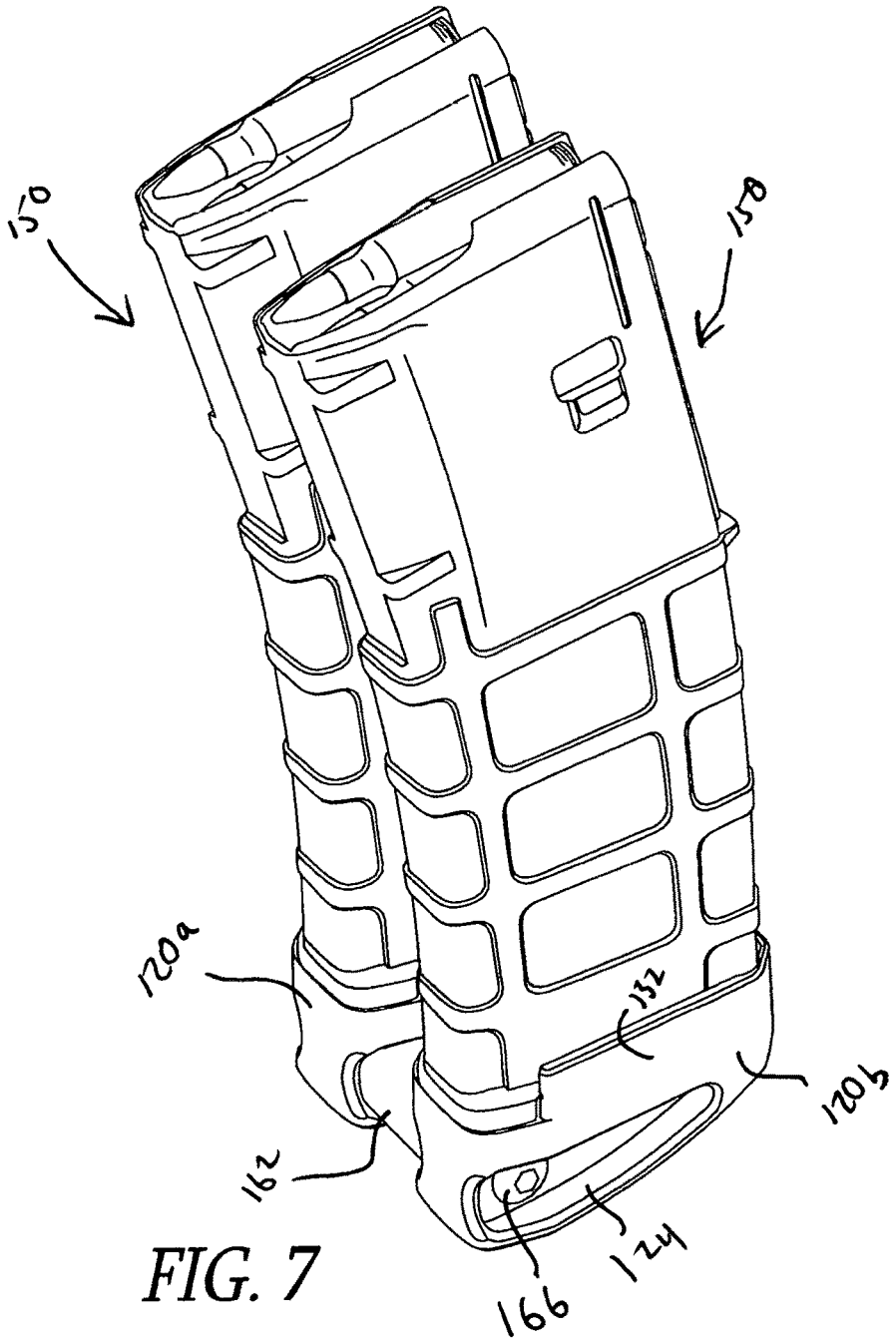
FIG. 7 is a perspective view of a pair of magazine assemblies, similar to the magazine assembly of FIGS. 5A and 5B, coupled together by a magazine coupler, according to an embodiment.

FIG. 6 is an exploded perspective view of a coupler assembly 160, according to an embodiment, and FIG. 7 is a perspective view of a pair of magazine assemblies 150 similar to the magazine assembly 150 of FIGS. 5A, 5B, coupled together by a magazine coupler 162, according to an embodiment.

The coupler assembly 160 of FIG. 6 includes first and second floorplates 120*a*, 120*b*, a magazine coupler 162, and fasteners 164. Threaded apertures 166 extend into ends 168 of the magazine coupler 162. According to an embodiment, the threaded apertures 166 meet inside the magazine coupler 162, forming a single through-aperture. The ends 168 of the magazine coupler 162 are shaped to fit snuggly into the engagement sockets 124 of the floor plates 120. To assemble, a user passes one of the fasteners 164 from one side of the first floorplate 120*a* into a threaded aperture 166 of the magazine coupler 162 via the through aperture 126, and the other fastener into the other threaded aperture 166 of the coupler via the through aperture 126 of the second floorplate 120*b*. As the fasteners 164 are tightened, the respective ends of the magazine coupler 162 are drawn tightly into the corresponding engagement sockets 124 until the first and second floorplates 120*a*, 120*b* are rigidly coupled to each other via the magazine coupler 162.

The magazine assemblies 150 of FIG. 7 are held in firm or rigid relation to each other by the magazine coupler 162, which allows a user to quickly switch them in the magazine well of a firearm, reducing the amount of handling required and accelerating the procedure. The mating of the ends of the magazine coupler 162 with the engagement sockets 124 permits the use of a single fastener 164 on each side without the danger of relative rotation of the assemblies if a fastener becomes loosened. This simplifies assembly and disassembly while securely keeping the magazine assemblies in proper orientation, relative to each other.

Many of the advantages and benefits provided have been described. Another significant advantage is that, according to various embodiments, various combinations of features are combined in a single element or a small number of elements. For example, according to an embodiment, a magazine floorplate is provided that increases a magazine capacity, provides an improved handling surface that extends beyond the end of the magazine housing for improved access in tight spaces, and easier and faster exchanging of magazines, and that provides a stable base on which to rest a firearm for more accurate shooting. Additionally, with the addition of a coupler element and two fasteners, two magazine assemblies can be quickly, easily, and securely coupled together to form a tandem magazine, and can be just as easily decoupled to separate into individual magazines.

In some of the drawings, elements are designated with a reference number followed by a letter, e.g., "218*a*, 218*b*." In such cases, the letter designation is used where it may be useful in the corresponding description to refer to or differentiate between specific ones of a number of otherwise similar or identical elements. Where the description omits the letter from a reference, and refers to such elements by number only, this can be understood as a general reference to the elements identified by that reference number, unless other distinguishing language is used.

Ordinal numbers, e.g., first, second, third, etc., are used in the claims according to conventional claim practice, i.e., for the purpose of clearly distinguishing between claimed elements or features thereof, etc. Ordinal numbers may be assigned arbitrarily, or assigned simply in the order in which elements are introduced. The use of such numbers does not suggest any other relationship, such as order of operation, relative position of such elements, etc. Furthermore, an ordinal number used to refer to an element in a claim should not be assumed to correlate to a number used in the specification to refer to an element of a disclosed embodiment on which that claim reads, nor to numbers used in unrelated claims to designate similar elements or features.

The abstract of the present disclosure is provided as a brief outline of some of the principles of the invention according to one embodiment, and is not intended as a complete or definitive description of any embodiment thereof, nor should it be relied upon to define terms used in the specification or claims. The abstract does not limit the scope of the claims.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An assembly, comprising:

a first magazine floorplate, including:

a magazine receiving structure configured to engage a corresponding structure of a firearm magazine housing and hold the magazine floorplate in a floorplate position relative to the housing, a first coupler engagement structure formed on a first side of the floorplate and configured to receive a corresponding structure of a magazine coupler, and a second coupler engagement structure formed on a second side of the floorplate, opposite the first side, and configured to receive a corresponding structure of a magazine coupler, and a magazine coupler having, at a first end, a first floorplate engagement structure corresponding to the first coupler engagement structure of the floorplate and configured to mate with the first coupler engagement structure, and, at a second end, a second floorplate engagement structure corresponding to the second coupler engagement structure of the floorplate and configured to mate with the second coupler engagement structure; and wherein the first coupler engagement structure of the first magazine floorplate comprises a first engagement socket extending into the first side of the first magazine floorplate; the second coupler engagement structure of the first magazine floorplate comprises a second engagement socket extending into the second side of the first magazine floorplate; the first floorplate engagement structure of the magazine coupler comprises the first end of the magazine coupler, which is shaped such that the first end of the magazine coupler fits snugly into the first engagement socket of the first coupler engagement structure of the first magazine floorplate; and the second floorplate engagement structure of the magazine coupler comprises the second end of the magazine coupler, which is shaped such that the second end of the magazine coupler fits snugly into the second engagement socket of the second coupler engagement structure of the first magazine floorplate.

2. The assembly of claim 1 comprising a second magazine floorplate that is substantially identical to the first magazine floorplate, including a first coupler engagement structure configured to receive a corresponding structure of a magazine coupler, and a second coupler engagement structure configured to receive a corresponding structure of a magazine coupler.

3. The assembly of claim 2 wherein the first floorplate engagement structure of the magazine coupler is mated with the first coupler engagement structure of the first magazine floorplate and the second floorplate engagement structure of the magazine coupler is mated with the second coupler engagement structure of the second magazine floorplate.

4. The assembly of claim 1 wherein:

the first magazine floorplate comprises a floorplate aperture extending through the first magazine floorplate between the first and second sockets;

the first floorplate engagement structure of the magazine coupler comprises a first threaded aperture extending into the first end of the magazine coupler; and the second floorplate engagement structure of the magazine coupler comprises a second threaded aperture extending into the second end of the magazine coupler.

5. The assembly of claim 4 comprising a second magazine floorplate that is substantially identical to the first magazine floorplate, and wherein:

the first magazine floorplate is rigidly coupled to the magazine coupler by a threaded fastener extending through the floorplate aperture of the first magazine floorplate and into the first threaded aperture of the first floorplate engagement structure of the magazine coupler, with the first end of the magazine coupler fitted snuggly into the first engagement socket of the first coupler engagement structure;

the second magazine floorplate is rigidly coupled to the magazine coupler by a threaded fastener extending through a floorplate aperture of the second magazine floorplate and into the second threaded aperture of the second floorplate engagement structure of the magazine coupler, with the second end of the magazine coupler fitted snuggly into the second engagement socket of the second coupler engagement structure.

6. The assembly of claim 5, comprising:

a first firearm magazine that is coupled to the first magazine floorplate by the magazine receiving structure of the first magazine floorplate, which engages a corresponding structure of the first firearm magazine; and a second firearm magazine that is coupled to the second magazine floorplate by a magazine receiving structure of the second magazine floorplate, which engages a corresponding structure of the second firearm magazine;

the first and second firearm magazine being held in fixed positions, relative to each other, by their respective couplings with the first and second magazine floorplates and by respective rigid couplings of the first and second magazine floorplates with the magazine coupler.

7. The assembly of claim 1 wherein the first magazine floorplate includes a magazine extension cavity configured to increase a magazine capacity while the magazine floorplate is in the floorplate position relative to the magazine.

8. The assembly of claim 1 wherein the magazine receiving structure of the first magazine floorplate is configured to slidably engage and disengage the corresponding structure of the firearm magazine.

9. The assembly of claim 8 wherein the first magazine floorplate comprises a springplate tab aperture extending into a floorplate face of the magazine floorplate, configured to receive therein a tab of a spring plate of the magazine, the first magazine floorplate being configured to interact with the magazine such that while the magazine receiving structure engages the corresponding structure of the firearm magazine and the tab of the springplate is received into the springplate tab aperture, the first floorplate is prevented from slidably disengaging from the firearm magazine.

10. The assembly of claim 9 wherein the first magazine floorplate comprises a springplate release aperture extending through the first magazine floorplate between the floorplate face and a side opposite the floorplate face, positioned so as to intersect the springplate tab aperture, such that the tab of the springplate can be disengaged from the springplate tab aperture by application of a bias against the tab in a direction from the side of the floorplate opposite the floorplate face toward the floorplate face.

11. The assembly of claim 9 wherein the springplate release aperture is sized to receive a spent cartridge shell.

12. The assembly of claim 9 wherein the first magazine floorplate comprises:

a floorplate face configured such that while the magazine floorplate is in the floorplate position relative to the magazine, the floorplate face is positioned to receive a springplate of the magazine; and a bearing surface on a side of the magazine floorplate opposite the floorplate face, the bearing surface having a generally curved contour.

13. The assembly of claim 12 wherein the bearing surface has a textured surface configured to resist sliding on irregular surfaces.

* * * * *